US008912505B2

(12) United States Patent
Baik et al.

(10) Patent No.: US 8,912,505 B2
(45) **Date of Patent: *Dec. 16, 2014**

(54) ELECTRON BEAM FOCUSING ELECTRODE AND ELECTRON GUN USING THE SAME

(71) Applicant: Samsung Electronics Co., Ltd., Suwon-Si, Gyeonggi-Do (KR)

(72) Inventors: Chan Wook Baik, Seongnam-si (KR); Anurag Srivastava, Seoul (KR); Jong Min Kim, Suwon-si (KR); Sun Il Kim, Seoul (KR); Young Mok Son, Hwaseong-si (KR); Gun Sik Park, Seoul (KR); Jin Kyu So, Seoul (KR)

(73) Assignees: Samsung Electronics Co., Ltd., Gyeonggi-do (KR); Seoul National University Industry Foundation, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/644,890

(22) Filed: Oct. 4, 2012

(65) Prior Publication Data

US 2013/0193340 A1 Aug. 1, 2013

Related U.S. Application Data

(63) Continuation of application No. 12/285,671, filed on Oct. 10, 2008, now Pat. No. 8,304,743.

(30) Foreign Application Priority Data

May 20, 2008 (KR) ..... 10-2008-0046748

(51) Int. Cl.

| | |
|---|---|
| ***G21K 5/04*** | (2006.01) |
| ***H01J 1/46*** | (2006.01) |
| ***H01J 1/13*** | (2006.01) |
| ***G21K 1/087*** | (2006.01) |
| ***H01J 1/30*** | (2006.01) |

(52) U.S. Cl.

CPC . *G21K 1/087* (2013.01); *H01J 1/46* (2013.01); *H01J 1/13* (2013.01); *H01J 1/30* (2013.01)

USPC ..... 250/396 R; 250/397; 250/492.1; 250/492.3

(58) Field of Classification Search

CPC ..... H01J 37/10; H01J 37/141; H01J 37/147; G21K 5/00; G21K 5/04

USPC ..... 250/396 R, 397, 398, 396 ML, 492.1, 250/492.22, 492.3

See application file for complete search history.

(56) References Cited

U.S. PATENT DOCUMENTS 4,683,366 A * 7/1987 Harte et al. ..... 219/121.25
4,873,468 A 10/1989 Miram et al.

(Continued)

FOREIGN PATENT DOCUMENTS

| | | |
|---|---|---|
| CN | 1369104 | 9/2002 |
| EP | 1753010 | 2/2007 |

(Continued)

OTHER PUBLICATIONS

Korean Office Action dated May 31, 2013 issued in corresponding Korean Application No. 10-2008-0046748.

(Continued)

*Primary Examiner* — Nicole Ippolito

(74) *Attorney, Agent, or Firm* — Harness, Dickey & Pierce, P.L.C.

(57) ABSTRACT

An electron beam focusing electrode and an electron gun using the same may include a plate having a polygonal through-hole; at least a projecting portion formed on at least one side of the through-hole. By using the electron beam focusing electrode, a spreading phenomenon of an electron beam having a rectangular cross section may be reduced. Further, the output of the electron gun may be increased, and electron beams may be easily focused.

11 Claims, 9 Drawing Sheets

(56) References Cited

U.S. PATENT DOCUMENTS

| | | | | |
|---|---|---|---|---|
| 5,097,138 | A * | 3/1992 | Wakabayashi et al. | 250/492.2 |
| 6,512,235 | B1 * | 1/2003 | Eitan et al. | 250/423 F |
| 8,304,743 | B2 * | 11/2012 | Baik et al. | 250/396 R |
| 2007/0170372 | A1 | 7/2007 | Horsky | |
| 2010/0227200 | A1 * | 9/2010 | Miyata et al. | 428/800 |

FOREIGN PATENT DOCUMENTS

| | | |
|---|---|---|
| JP | 1985-074336 | 4/1985 |
| JP | 1986-114449 | 6/1986 |
| JP | 1987-206754 | 9/1987 |
| JP | 2003-242904 | 8/2003 |
| KR | 10-2000-0038623 | 7/2000 |
| KR | 10-2001-0037658 | 5/2001 |
| KR | 100351802 | 8/2002 |
| KR | 10-0719533 | 5/2007 |
| WO | WO 2007/129376 | 11/2007 |

OTHER PUBLICATIONS

Korean Office Action dated Nov. 15, 2013 issued in corresponding Korean Application No. 10-2008-0046748.

Chinese Office Action dated May 8, 2013 issued in corresponding Chinese Application No. 200910007066.2.

* cited by examiner

A - A

B - B

ELECTRON BEAM FOCUSING ELECTRODE AND ELECTRON GUN USING THE SAME

PRIORITY STATEMENT

This application is a continuation of U.S. patent application Ser. No. 12/285,671, filed on Oct. 10, 2008, which claims priority to Korean Patent Application No. 10-2008-46748 filed on May 20, 2008, under 35 U.S.C. §119, the entire contents of both of which are incorporated herein by reference.

BACKGROUND

1. Field

Example embodiments relate to an electron beam focusing electrode and an electron gun using the same. Particularly, example embodiments relate to an electron beam focusing electrode that reduces a spreading phenomenon of electron beams by passing electron beams radiated from a cathode electrode of the electron gun through a through-hole having a desired and/or predetermined sectional shape, as well as an electron gun including the electron beam focusing electrode.

2. Discussion of the Related Art

In manufacturing a vacuum device for oscillation of microwaves and terahertz waves, an electron gun is used for allowing electron beams to be irradiated onto the device. A conventional electron gun generates an electron beam having a solid or annular section. In order to utilize an electron beam having a solid or annular section, the electron beam should be incident into a pattern formed on a surface of a substrate, or the like. However, as the size of a device becomes smaller and smaller, it is more and more difficult to allow an electron beam to be incident into a fine pattern. Another conventional electron gun generates an electron beam having a rectangular section. However, the electron beam having a rectangular section generated by the conventional electron gun has less laminarity than a solid or annular beam.

The above information disclosed in this Background section is only for enhancement of understanding of the background of the present application. Therefore, it may contain information that does not form the prior art that is already known in this country to a person of ordinary skill in the art.

SUMMARY

Example embodiments are provided at least in part to address issues, which may prevent conventional devices from outputting a predetermined and/or desired beam. For example, there is provided device and a method to address an issue relating to less laminarity than a solid or annular beam.

An example embodiment provides an electron beam focusing electrode, which may be included in an electron gun. The electron beam focusing electrode may include a plate having a polygonal through-hole and a projecting portion formed on at least one side of the through-hole.

According to an example embodiment, the projecting portion may be spaced apart from both ends of the side on which the projecting portion is formed. A length of the projecting portion may be smaller than the distance from a center of the through-hole to the side on which the projecting portion is formed.

According to an example embodiment, an inner surface of the through-hole is inclined with respect to a traveling direction of an electron beam passing through the through-hole. The through-hole may have a first area and a second area. The first area may be smaller than the second area. Further, the first area may be an incident area of an electron beam, and the second area may be an emission area of the electron beam.

According to an example embodiment, the polygonal through-hole may include four sides, and four projecting portions respectively arranged on the four sides. Each projecting portion may protrude from a center of the respective side. Each projecting portion may have a rectangular cross section.

Another example embodiment provides an electron gun. The electron gun may include an electron beam focusing electrode such as the electron beam focusing electron described above in this summary. The electron gun may also include a cathode electrode radiating electrons and an anode electrode spaced apart from the cathode electrode and on which the electrons radiated from the cathode electrode are focused.

According to an example embodiment, the electron beam focusing electrode of the electron gun may be electrically isolated from the cathode electrode of the electrode gun. Alternatively, the electron beam focusing electrode of the electron gun may be connected to the cathode electrode of the electron gun.

According to an example embodiment, the electron gun may include a gate electrode positioned between the electron beam focusing electrode and the anode electrode to adjust a current quantity of an electron beam.

According to an example embodiment, the cathode electrode of the electron gun may be one of a cold emission cathode, a photocathode and a plasma source. The electron gun may also include a heat shield mounted around the cathode electrode to shield heat radiated from the cathode electrode.

Still another example embodiment provides a method of reducing a spreading phenomenon of an electron beam with rectangular cross section. The method may include forming an electric field in a polygonal through-hole having a projection portion arranged on at least one side of the through-hole, passing an electron beam through the through-hole, and forming a predetermined cross section for the electron beam by the electric field. The method may also include using a gate electrode to adjust a current quantity of the electron beam.

BRIEF DESCRIPTION OF THE DRAWINGS

The above and other objects, features and other advantages of example embodiments will be more clearly understood from the following detailed description taken in conjunction with the accompanying drawings, in which.

Figure 1A:
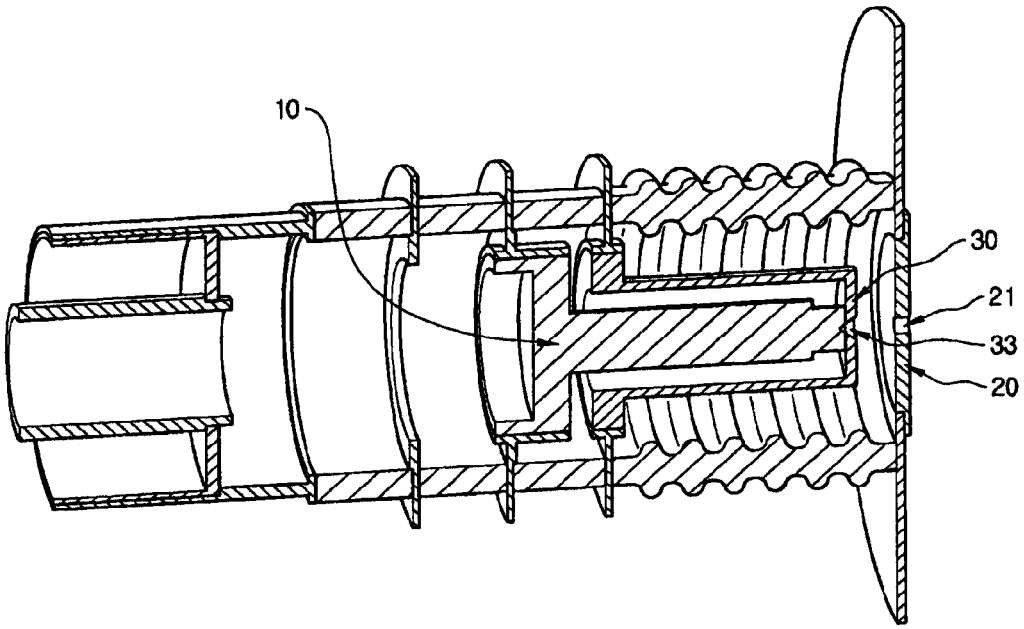
FIG. 1A is a cross-sectional perspective view of an electron gun according example embodiments.

It should be understood that the appended drawings are not necessarily to scale, present a somewhat simplified representation of various preferred features illustrative of the basic principles of this disclosure. The specific design features disclosed herein, including, for example, specific dimensions, orientations, locations and shapes will be determined in part by the particular intended application and use environment.

In the figures, like reference numerals refer to the same or equivalent parts of example embodiments throughout the following detailed description.

DETAILED DESCRIPTION OF EXAMPLE EMBODIMENTS

Example embodiments are described more fully hereinafter with reference to the accompanying drawings, in which example embodiments are shown. Example embodiments may, however, be embodied in many different forms and should not be construed as limited to the example embodiments set forth herein. Rather, these embodiments are provided so that this disclosure will be thorough and complete, and will fully convey the scope of example embodiments to those skilled in the art. In the drawings, the size and relative sizes of regions may be exaggerated for clarity.

It will be understood that when an element is referred to as being "on," "connected to" or "coupled to" another element and the like, it can be directly on, connected or coupled to the other element or layer or intervening elements or layers may be present. In contrast, when an element is referred to as being "directly on," "directly connected to" or "directly coupled to" another element or layer, there are no intervening elements present. As used herein, the term "and/or" includes any and all combinations of one or more of the associated listed items.

It will be understood that, although the terms first, second, third etc. may be used herein to describe various elements, components, regions, and/or sections, these elements, components, regions and/or sections should not be limited by these terms. These terms are only used to distinguish one element, component, region or section from another region or section. Thus, a first element, component, region or section discussed below could be termed a second element, component, region or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1B:
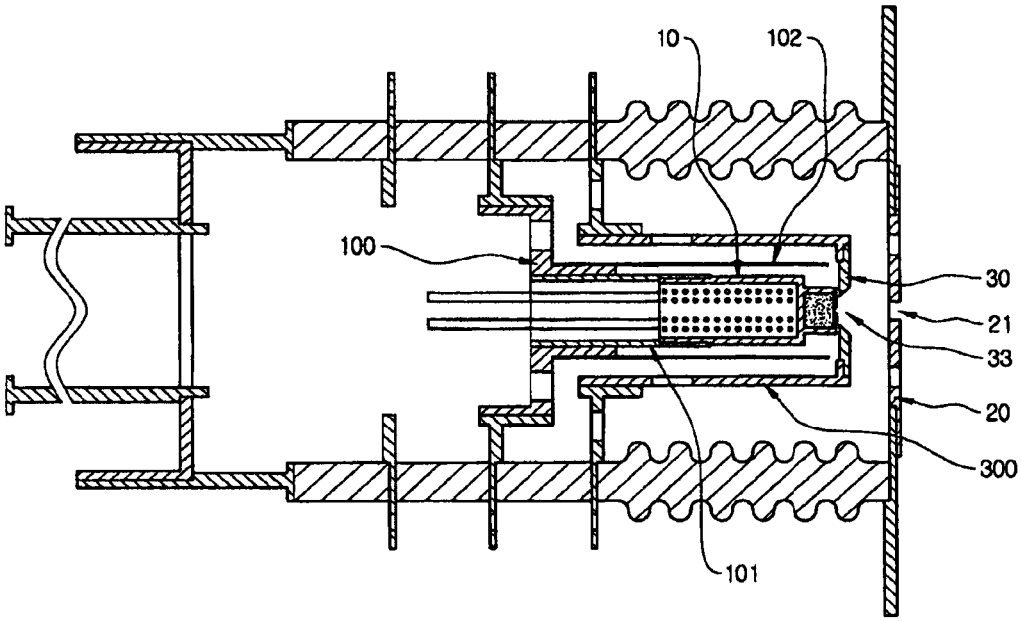
FIG. 1B is a longitudinal cross-sectional view of the electron gun shown in FIG. 1A.

FIG. 1A is a cross-sectional perspective view of an electron gun according to example embodiments, and FIG. 1B is a longitudinal cross-sectional view of the electron gun shown in FIG. 1A.

Referring to FIG. 1A, the electron gun may include a cathode electrode 10, an anode electrode 20 and an electron beam focusing electrode 30.

The cathode electrode 10 may be a device to radiate electrons. For example, the cathode electrode 10 may be a device using thermionic emission, or may be a cold emission cathode, a photocathode or a plasma source.

Referring to FIG. 1B, the cathode electrode 10 may be fixed at a desired and/or predetermined position in the electron gun by a cathode base 100 and a cathode support sleeve 101 according to an example embodiment. If the cathode electrode 10 is a device using thermionic emission, a heat shield 102 for shielding heat radiated from the heated cathode electrode 10 may be mounted around the cathode electrode 10.

The anode electrode 20 may be spaced apart from the cathode electrode 10 at a desired and/or predetermined distance. A voltage may be applied between the cathode electrode 10 and the anode electrode 20. Electrons radiated from the cathode electrode 10 may be accelerated by the applied voltage, so that electron beams may be formed in a direction towards the anode electrode 20.

Further, the anode electrode 20 may have a hole 21 at the center thereof, according to an example embodiment. Electrons radiated from the cathode electrode 10 may pass the anode electrode 20 through the hole 21 to be emitted from the electron gun and may reach a collector (not shown) thereafter. The collector may be an anode electrode positioned outside the electron gun.

Referring to FIG. 1B, the electron beam focusing electrode 30 may be fixed at a desired and/or predetermined position between the cathode electrode 10 and the anode electrode 20 by a cylinder-shaped base 300. In an example embodiment, the electron beam focusing electrode 30 may include a plate having a polygonal through-hole 33 formed therein, so that a more desirable electric field may be formed. When electrons radiated from the cathode electrode 10 pass the electron beam focusing electrode 30 through the through-hole 33, an electron beam may be formed to have a predetermined and/or desired cross-sectional shape.

According to an example embodiment, the electron gun may further include a gate electrode (not shown) positioned between the electron beam focusing electrode 30 and the anode electrode 20 for adjusting the current quantity of an electron beam.

Figure 2:
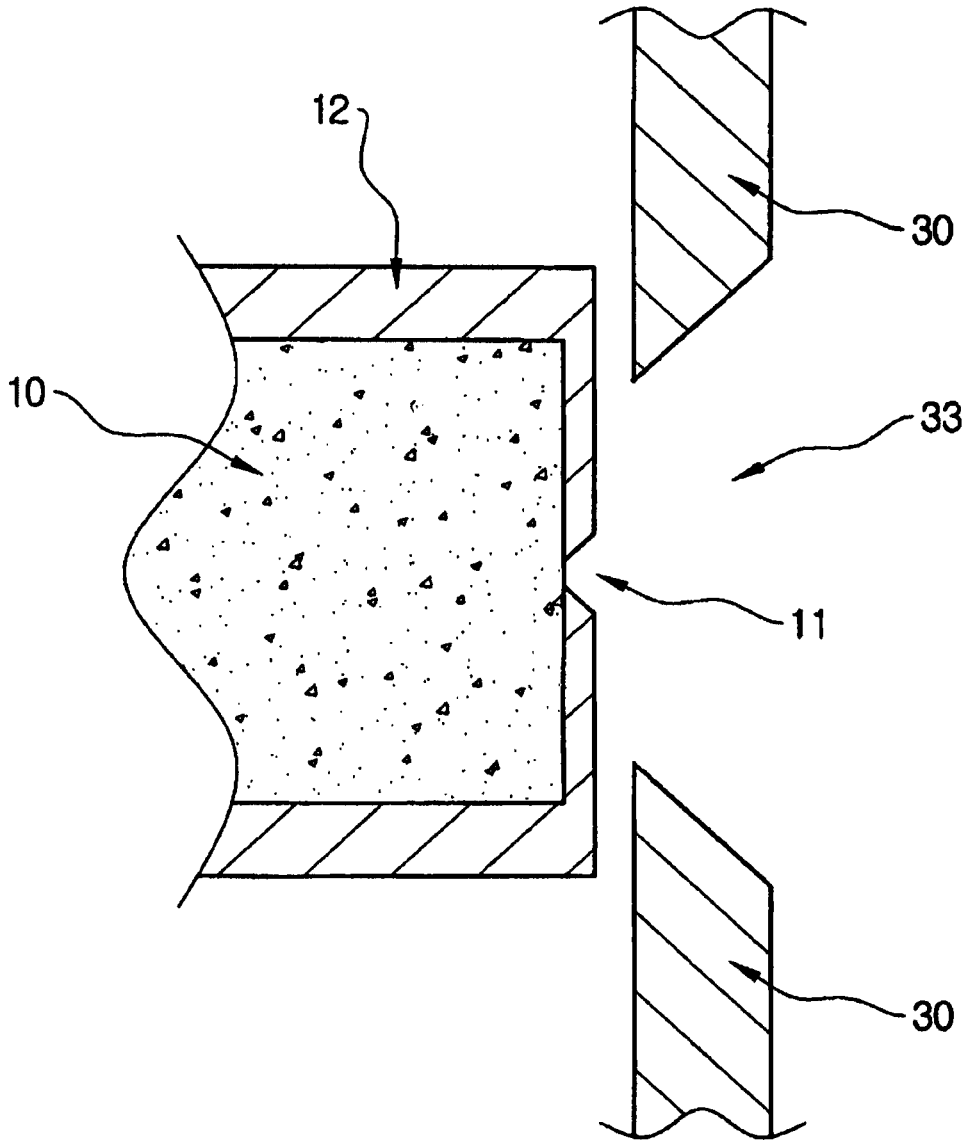
FIG. 2 is an enlarged longitudinal cross-sectional view showing a vicinity of a through-hole of the electron gun shown in FIG. 1A.

FIG. 2 is an enlarged longitudinal cross-sectional view showing a vicinity of the through-hole 33 of the electron gun, according to example embodiments.

Referring to FIG. 2, the electron beam focusing electrode 30 may be positioned in front of the cathode electrode 10 from which electrons may be radiated. The cathode electrode 10 may be surrounded by the cathode sleeve 12. The cathode sleeve 12 may have a desired and/or predetermined emission hole 11. Electrons radiated from the cathode electrode 10 may be emitted in a direction toward the electron beam focusing electrode 30 through the emission hole 11 of the cathode sleeve 12. When the emitted electrons pass through the through-hole 33 of the electron beam focusing electrode 30, an electron beam may be formed and a sectional shape of the electron beam may be determined by an electric field formed therein. The electric field may be formed depending on the shape of the through-hole 33. The cathode electrode 10 and the cathode sleeve 12 will be described later with reference to FIG. 4.

Referring to FIG. 2, the cathode sleeve 12 and the electron beam focusing electrode 30 may be spaced apart from each other at a desired and/or predetermined distance and may be electrically isolated from each other, according to an example embodiment. Therefore, the electron beam focusing electrode 30 may be electrically isolated from the cathode electrode 10, which may be connected to the cathode sleeve 12.

According to an example embodiment, the cathode electrode 10 and the electron beam focusing electrode 30 may have the same electric potential or may have different electric potentials to control a trace of the electron beam. When different electric potentials are applied to the cathode electrode 10 and the electron beam focusing electrode 30, a potential difference between the cathode electrode 10 and the electron beam focusing electrode 30 may be determined that does not breakdown the isolation between the cathode electrode 10 and the electron beam focusing electrode 30.

According to another example embodiment, the electron beam focusing electrode 30 and the cathode electrode 10 may be connected to each other. For example, the electron beam focusing electrode 30 and the cathode electrode 10 may be connected through the cathode sleeve 12 by connecting the electron beam focusing electrode 30 to the cathode sleeve 12.

Figure 3A:
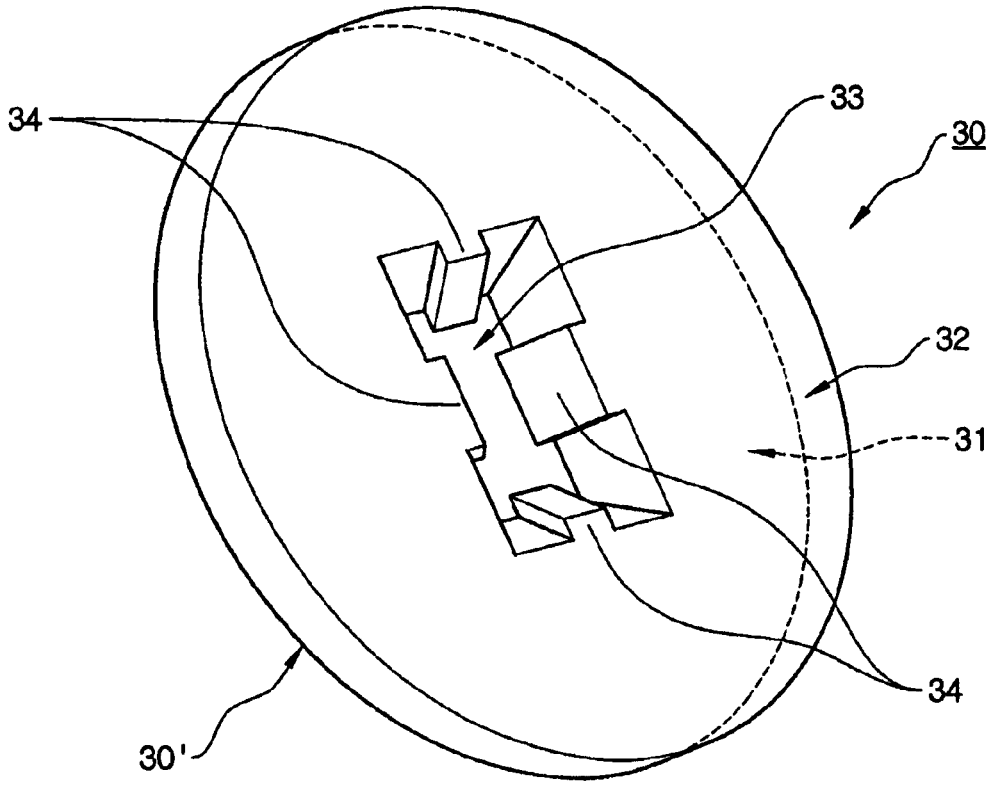
FIG. 3A is a perspective view of an example embodiment of an electron beam focusing electrode.

FIG. 3A is a perspective view of an electron beam focusing electrode according to an example embodiment. Referring to FIG. 3A, the electron beam focusing electrode 30 may include a plate 30' having a first surface 31, a second surface opposing the first surface 31, and a polygonal through-hole 33 passing through the electron beam focusing electrode 30. The polygonal through-hole 33 may include projecting portions 34 protruding inside the through-hole 33 from respective sides of the through-hole 33. For example, the polygon of the through-hole 33 may have four sides. Each side may have one projecting portion formed on the center of the side. Each projecting portion may have a rectangular cross-section and may protrude from each side of the polygon.

Electrons radiated from a cathode electrode may be incident onto the first surface 31 of the electron beam focusing electrode 30. Because the through-hole 33 may be formed to pass through the first surface 31 and the second surface 32, the electrons may incident to the through-hole 33 from the first surface 31, pass through the through-hole 33, and then may be emitted from the through-hole 33 from the second surface 32.

Referring to FIG. 3A, the through-hole 33 may further include at least one projecting portion 34 formed on at least one side of the through-hole 33. Distortion of an electric field at an edge of the electron beam may be reduced due to the projecting portion 34 and traces of electrons passing through the through-hole 33 may be controlled. Consequently, the laminarity of electron beams emitted from the electron gun may be improved.

Figure 3B:
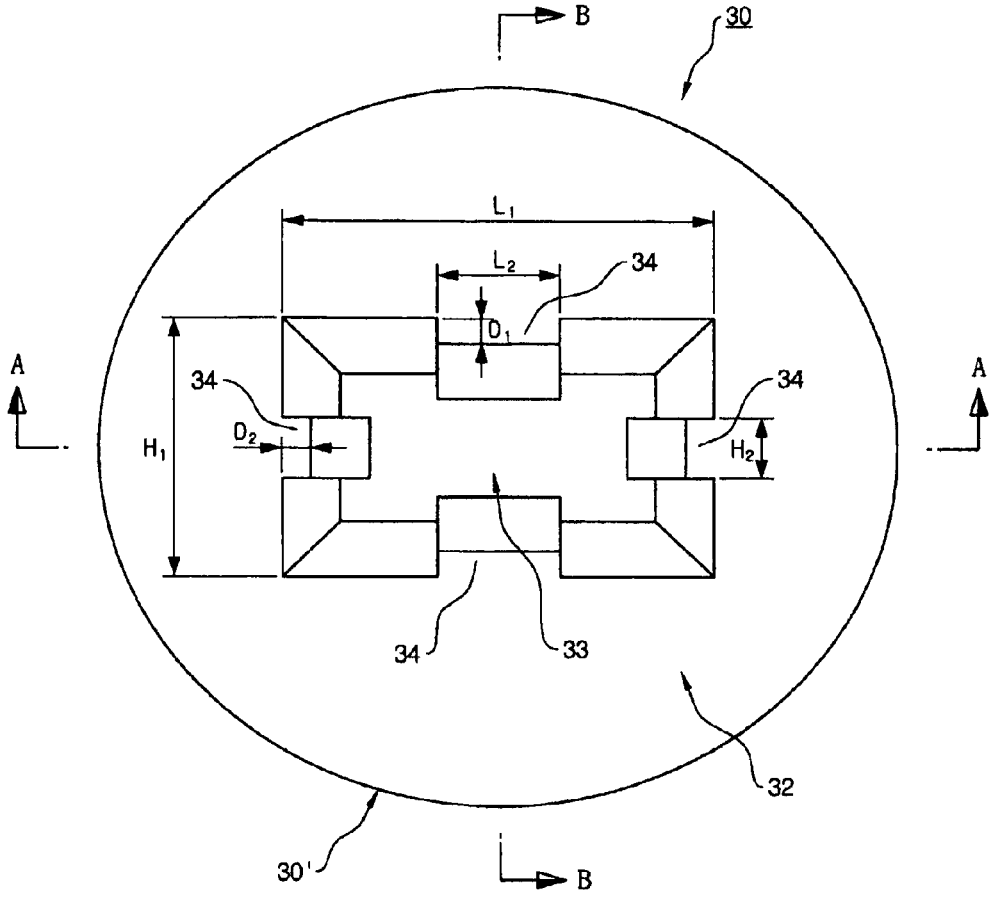
FIG. 3B is a plan view of the electron beam focusing electrode shown in FIG. 3A.
Figure 3C:
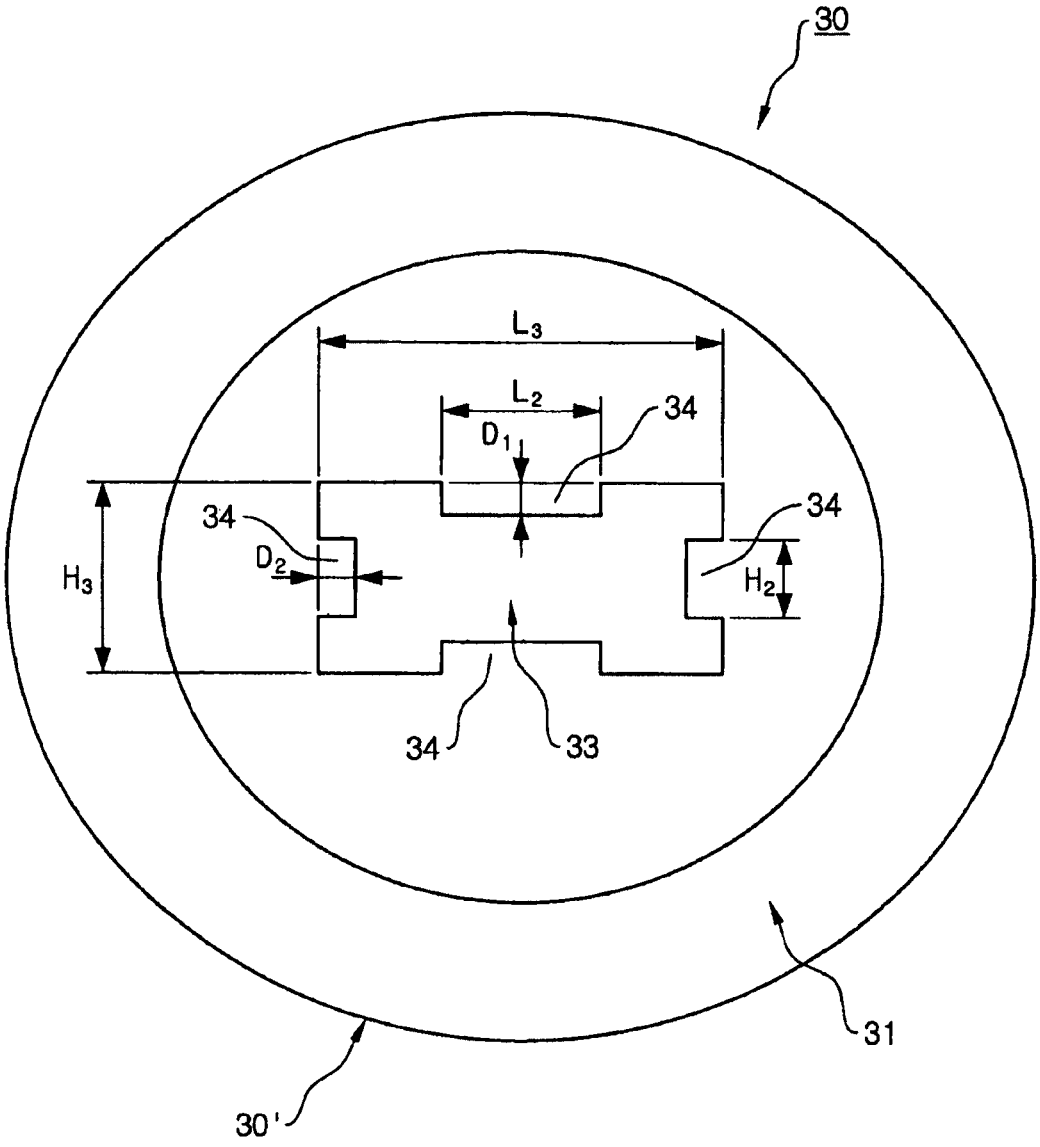
FIG. 3C is a bottom view of the electron beam focusing electrode shown in FIG. 3A.

FIG. 3B is a plan view of the second surface 32 of the electron beam focusing electrode, and FIG. 3C is a bottom view of the first surface 31 of the electron beam focusing electrode, according to an example embodiment. In the electron beam focusing electrode 30, the through-hole 33 of the plate 30' may have a first sectional area at the first surface 31 shown in FIG. 3C and a second sectional area at the second surface 32 shown in FIG. 3B. The first sectional area may be different from the second sectional area. For example, the second sectional area may be larger than the first sectional area. As a result, the section of the through-hole 33 may be formed to be inclined with respect to the traveling direction of an electron beam passing through the through-hole 33.

As shown in FIG. 3B, the through-hole 33 formed in the plate 30' at the second surface 32 has a length $L_1$ and a width $H_1$ in lateral and longitudinal directions of FIG. 3B, respectively. For example, a through-hole may have $L_1$=3.04 mm and $H_1$=2 mm.

At least one projecting portion 34 may be formed on at least one side of the through-hole 33. Each of the projecting portions 34 may be spaced apart with desired and/or predetermined distances from both ends of the respective side, on which the projecting portion 34 is formed. Each of the projecting portions 34 may be protruded by a desired and/or predetermined height towards a central direction of the through-hole 33. For example, as shown in FIG. 3B, the through-hole 33 may have one projecting portion protruded on each of the sides of the polygon, respectively, towards the center of the through-hole 33, each of the projecting portions 34 may be positioned at the center of the respective side and may be positioned apart from both of the two ends on the left side and the right side of the projection portion. The projecting portions 34 in the lateral and longitudinal directions may have lengths $L_2$ and $H_2$, and lengths $D_1$ and $D_2$, respectively. The length $D_1$ or $D_2$ of each of the projecting portions 34 may be formed to be smaller than the distance between the respective side to the center of the through-hole 33, so that two opposing projecting portions 34 may not protrude to touch each other. For example, projecting portions may have $L_2$=0.88 mm, $H_2$=0.48 mm, and $D_1$=$D_2$=0.4 mm.

Accordingly, the rectangular shaped through-hole 33 may be modified into a dumbbell shaped polygon by the projecting portions 34 protruded from each side of the rectangular through-hole 33. Consequently, the electric field in the through-hole 33 may be modified by the dumbbell shape of the through-hole 33, so that a spreading phenomenon of an electron beam at corners of the through-hole 33 may be reduced compared to a through-hole having a rectangular shape or a rectangular shape with curved corners.

When an electron beam passes through a rectangular or curved-corner rectangular through-hole of an electron beam focusing electrode, symmetry of electron distribution may be disrupted as a traveling distance of the electron beam increases. This may be because the electron beam is influenced by the distribution of electric field depending on the shape of the electron beam focusing electrode. This may also be because the initial velocity of the spread and initial electron speed due to the non-uniformity of a distribution of heat and electric field at the earlier stage of the electron beam generation.

If the aforementioned electron beam focusing electrode 30 with the dumbbell shape through-hole 33 is used, the trace of an electron beam passing through the through-hole may be controlled by the projecting portions 34. Consequently, a uniformity of the electron beam may be improved and/or a more uniform electron beam may be obtained.

FIG. 3C is a bottom view showing the first surface 31 of the electron beam focusing electrode 30. According to an example embodiment shown in FIG. 3C, the electron beam focusing electrode 30 may be formed by joining two circular electrodes having different diameters together. Alternatively, the electron beam focusing electrode 30 may also have a shape other than a circular shape or may include a number of electrodes other than two pieces.

The through-hole 33 formed in the plate 30' may have a lengths $L_3$ and $H_3$ in the lateral and longitudinal directions of the first surface 31, respectively. For example, a through-hole may have $L_3$=2.2 mm and $H_3$=1.16 mm.

At least one projecting portion 34 may be formed on at least one side of the through-hole 33. Each of the projecting portions 34 may be spaced apart with desired and/or predetermined distances from both ends of the respective side, on which the projecting portion 34 is formed. For example, each side of the through-hole 33 may have a projecting portions 34 formed at a center of the side, protruding to a center of the through-hole 33. The projecting portions 34 may have widths $L_2$ and $H_2$, and lengths $D_1$ and $D_2$, in the lateral and longitudinal directions, respectively.

Figure 3D:
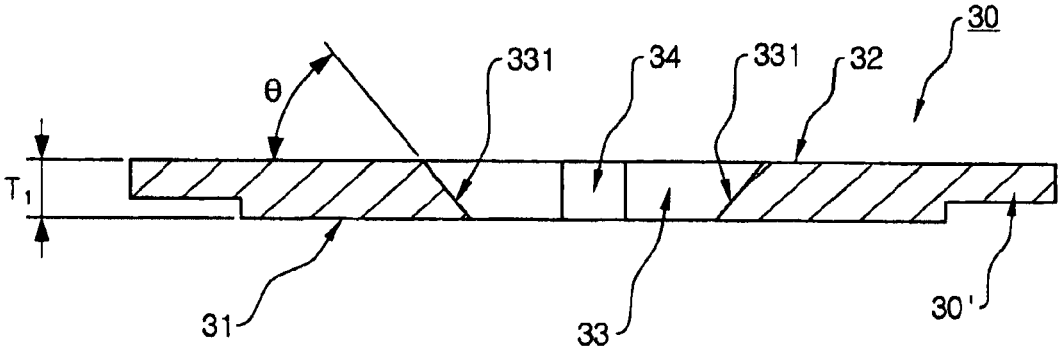
FIG. 3D is a front cross-sectional view of the electron beam focusing electrode shown in FIG. 3A.
Figure 3E:
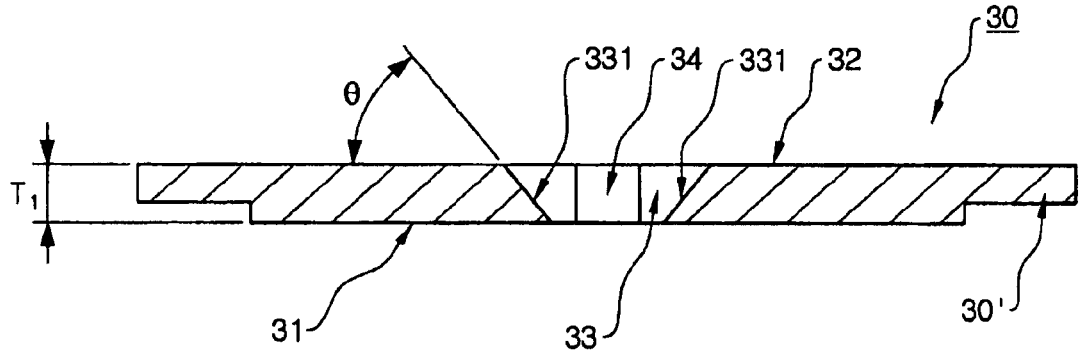
FIG. 3E is a right side cross-sectional view of the electron beam focusing electrode shown in FIG. 3A.

FIGS. 3D and 3E are cross-sectional views of the electron beam focusing electrode shown in FIGS. 3A along A-A and B-B, respectively, according to example embodiments. Referring to FIGS. 3D and 3E, the through-hole 33 formed in the plate 30' may be formed such that the sectional area at the second surface 32 of the electron beam focusing electrode 30 is larger than that at the first surface 31 of the electron beam focusing electrode 30. As a result, an inner surface 331 of the through-hole 33 may have an angle of Θ with respect to the first surface 31. Further, the through-hole 33 may have a thickness $T_1$. For example, an electron beam focusing electrode may have a through-hole in which Θ=50 degrees and $T_1$=0.5 mm.

Figure 4A:
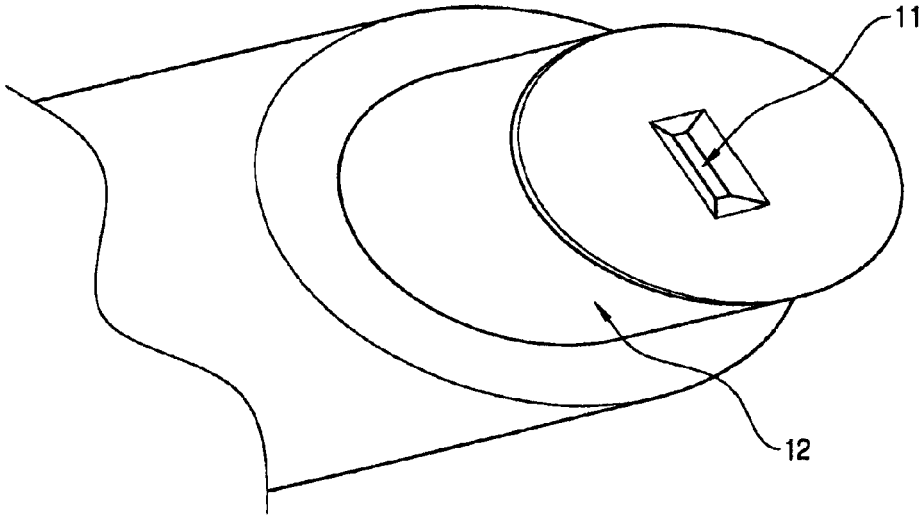
FIG. 4A is a perspective view showing a cathode electrode included in an electron gun according to an example embodiment.
Figure 4B:
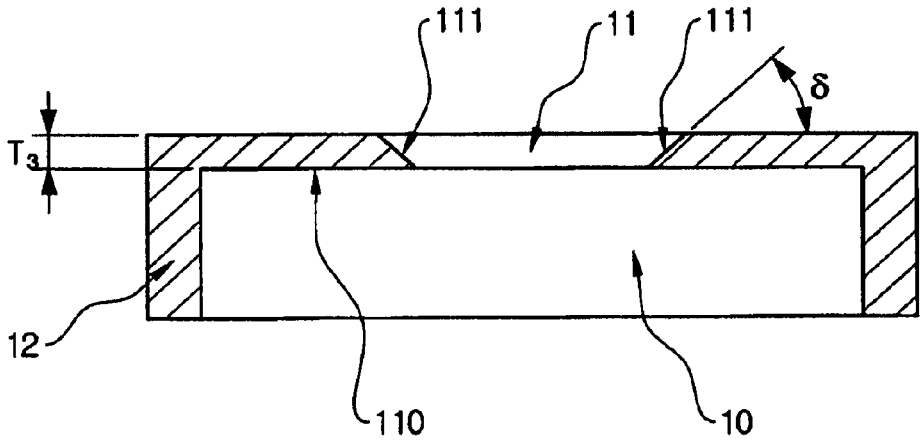
FIG. 4B is an enlarged longitudinal cross-sectional view of the cathode electrode shown in FIG. 4A.

FIG. 4A is an enlarged perspective view showing a portion of a cathode electrode 10 included in an electron gun according to an example embodiment, and FIG. 4B is a longitudinal cross-sectional view of the cathode electrode 10 shown in FIG. 4A.

Referring to FIGS. 4A and 4B, the cathode electrode 10 may be positioned in a cathode sleeve 12 having an emission hole 11 formed therein. Electrons radiated from the cathode electrode 10 may be emitted towards the electron beam focusing electrode 30 through the emission hole 11. An inner surface 111 of the emission hole 11 may be formed to make an angle of δ with respect to a surface 110 of the cathode electrode 10. Further, the emission hole 11 may have a thickness $T_3$. For example, an emission hole may have δ=30 degrees and $T_3$=0.06 mm.

Figure 4C:
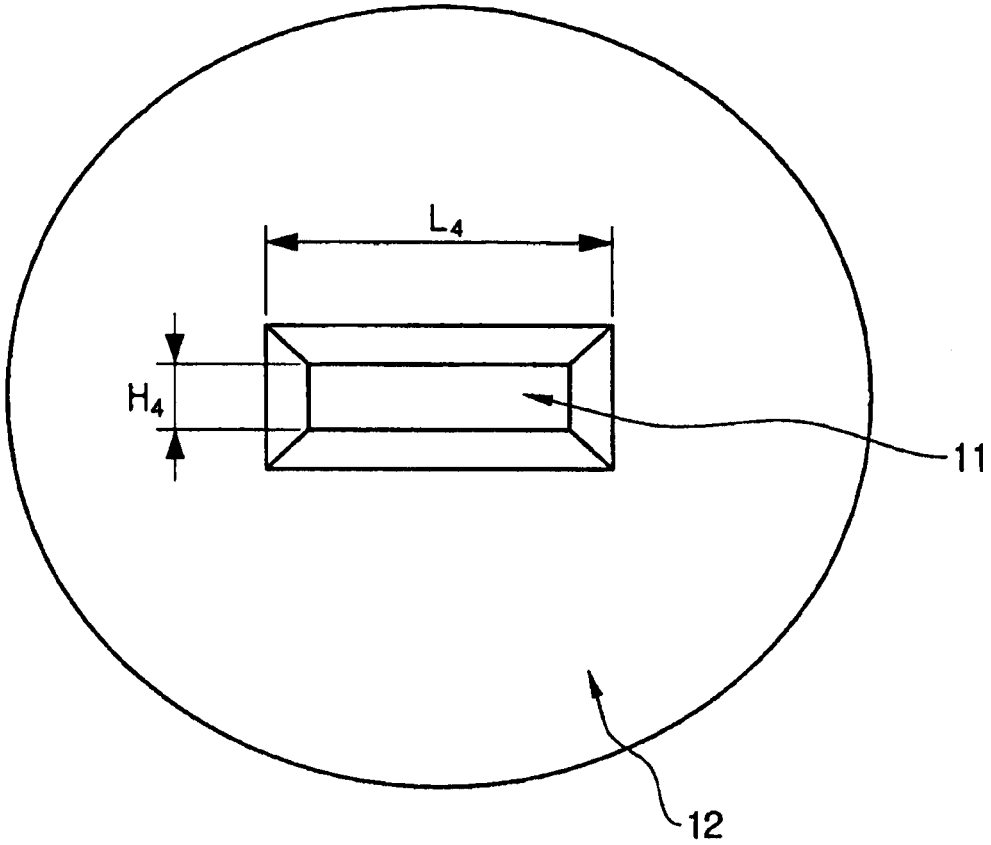
FIG. 4C is a plan view of the cathode electrode shown in FIG. 4A.

FIG. 4C is a plan view showing the emission hole 11 shown in FIGS. 4A and 4B. Referring to FIG. 4C, the emission hole 11 may be formed to have a rectangular section having lengths $L_4$ and $H_4$ in the lateral and longitudinal directions of FIG. 4C, respectively. For example, a cathode sleeve may have an emission hole in which $L_4$=0.6 mm and $H_4$=0.1 mm.

Referring back to FIG. 2, the electron beam focusing electrode 30 may be positioned to connect with or be spaced apart at a predetermined and/or desired distance from the cathode sleeve 12. Electrons may be radiated from the cathode electrode 10, and then may be emitted through the emission hole 11 to form an electron beam. A predetermined and/or desired sectional shape of the electron beam may be formed by an electric field when the electron beam passes through the electron beam focusing electrode 30.

Figure 5:
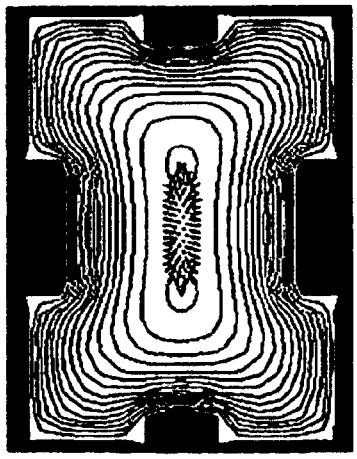
FIG. 5 is a schematic view showing equipotential lines and traces of electrons in an electron beam that passes through an electron beam focusing electrode according to an example embodiment.

FIG. 5 is a schematic view showing equipotential lines and traces of electrons in an electron beam that passes through an electron beam focusing electrode according to example embodiments. As shown in FIG. 5, the equipotential lines of the electron beam focusing electrode are controlled under the influence of projecting portions protruded from respective sides of the through-hole.

As shown in FIG. 5, if the electron beam focusing electrode having projecting portions protruded inside a through-hole is used, distortion of an electron beam distribution may be improved at corners of the electron beam. As a result, distortion and crossing at corners of an electron beam may be decreased and/or prevented and a shape of the electron beam cross section may not change significantly with respect to the distance that the electrons travel. Therefore, the shape of the electron beam cross section may be sustained longer.

Although example embodiments have been particularly shown and described with reference to FIGS. 1A-5, those skilled in the art will understand that various modifications, additions and substitutions in forms and details may be made without departing from the scope and spirit of example embodiments.

What is claimed is:

1. An electron beam focusing electrode, comprising:

a focusing plate having a polygonal through-hole and configured to receive an applied voltage; and a projecting portion formed on at least one side of the through-hole.

2. The electron beam focusing electrode according to claim 1, wherein the projecting portion is spaced apart from both ends of the side on which the projecting portion is formed.

3. The electron beam focusing electrode according to claim 1, wherein a length of the projecting portion is smaller than the distance from a center of the through-hole to the side on which the projecting portion is formed.

4. The electron beam focusing electrode according to claim 1, wherein the polygonal through-hole includes four sides, and four projecting portions respectively arranged on the four sides, each projecting portion protrudes from a center of the respective side.

5. The electron beam focusing electrode according to claim 4, wherein each of the projecting portions has a rectangular cross section.

6. A method of reducing a spreading phenomenon of an electron beam with rectangular cross section, comprising:

forming an electric field in a polygonal through-hole of a focusing plate of an electron beam focusing electrode, configured to receive an applied voltage from a power source, and having a projection portion arranged on at least one side of the through-hole;

passing an electron beam through the through-hole; and forming a cross section of the electron beam with the electric field.

7. The method of reducing a spreading phenomenon of an electron beam 1 with rectangular cross section according to claim 6, further comprising:

using a gate electrode to adjust a current quantity of the electron beam.

8. The electron beam focusing electrode according to claim 6, wherein the projecting portion is spaced apart from both ends of the side on which the projecting portion is formed.

9. The electron beam focusing electrode according to claim 6, wherein a length of the projecting portion is smaller than the distance from a center of the through-hole to the side on which the projecting portion is formed.

10. The electron beam focusing electrode according to claim 6, wherein the polygonal through-hole includes four sides, and four projecting portions respectively arranged on the four sides, each projecting portion protrudes from a center of the respective side.

11. The electron beam focusing electrode according to claim 10, wherein each of the projecting portions has a rectangular cross section.

* * * * *